United States Patent [19]

Rickert, Jr.

[11] 4,163,702

[45] Aug. 7, 1979

[54] PROCESS FOR RENDERING SURFACES PERMANENTLY WATER WETTABLE AND NOVEL PRODUCT THUS-PRODUCED

[75] Inventor: Milton E. Rickert, Jr., Louisville, Ky.

[73] Assignee: General Electric Company, Louisville, Ky.

[21] Appl. No.: 891,438

[22] Filed: Mar. 29, 1978

[51] Int. Cl.[2] ..... C23D 13/00; C25D 13/06; F25B 39/02

[52] U.S. Cl. ..... 204/181 T; 62/515; 427/388 A; 427/409

[58] Field of Search ..... 204/181 R, 181 T, 181 C; 427/409, 388 A; 62/515

[56] References Cited

U.S. PATENT DOCUMENTS 3,382,165 5/1968 Gilchrist ..... 204/181 R

*Primary Examiner*—Howard S. Williams

*Attorney, Agent, or Firm*—Millen & White

[57] ABSTRACT

The surfaces of articles of manufacture fabricated from aluminum and other material which are not permanently water wettable are rendered permanently water wettable by coating the surface with a continuous film of the free acid form of an acidic film forming polymer which forms water soluble salts, said film containing a curing agent for the polymer; contacting the polymer film under aqueous conditions with colloidal alumina or a polyvalent metal salt; curing the polymer to water insolubility; and, when required to render the cured film water wettable, hydrolyzing the surface portion only of the cured polymer.

36 Claims, 1 Drawing Figure

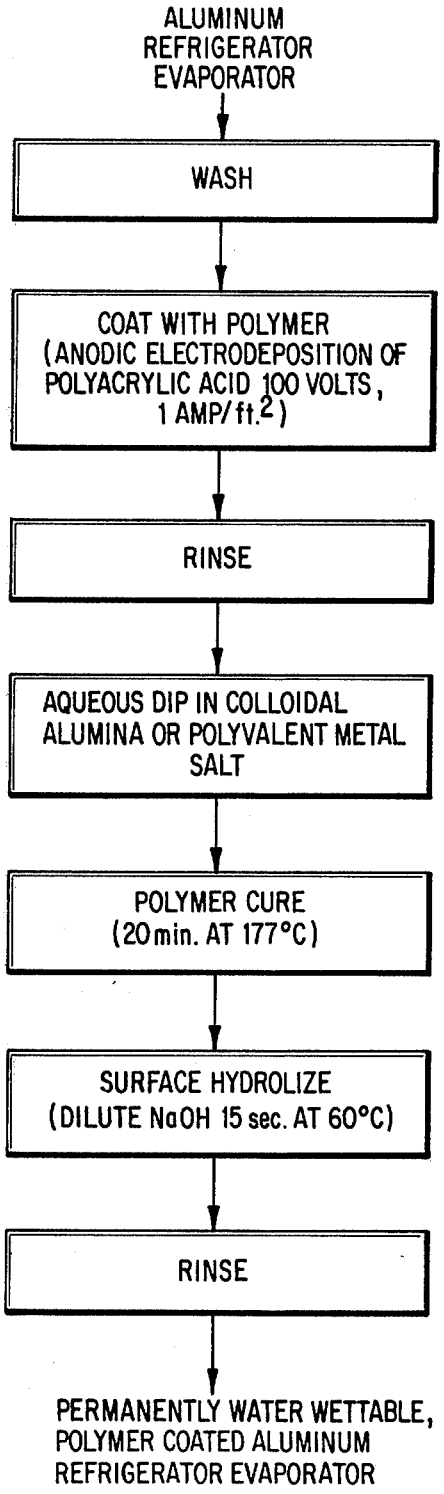
ALUMINUM
REFRIGERATOR
EVAPORATOR
WASH
COAT WITH POLYMER
(ANODIC ELECTRODEPOSITION OF
POLYACRYLIC ACID 100 VOLTS,
1 AMP/ft.2)
RINSE
AQUEOUS DIP IN COLLOIDAL
ALUMINA OR POLYVALENT METAL
SALT
POLYMER CURE
(20 min. AT 177°C)
SURFACE HYDROLIZE
(DILUTE NaOH 15 sec. AT 60°C)
RINSE
PERMANENTLY WATER WETTABLE,
POLYMER COATED ALUMINUM
REFRIGERATOR EVAPORATOR

PROCESS FOR RENDERING SURFACES PERMANENTLY WATER WETTABLE AND NOVEL PRODUCT THUS-PRODUCED

BACKGROUND OF THE INVENTION

This invention relates to a process for rendering surfaces permanently water wettable and to water wettable articles of manufacture thus-produced.

It is sometimes desirable that a surface of an article of manufacture exposed to water be water wettable. The term "water wettable" as used herein means the ability of the surface to retain a substantially unbroken film of water thereon, preferably for at least 10 seconds and more preferably for at least 30 seconds after removal from water, e.g., after being immersed in water or flushed with a stream of water. This property is desirable because a water wettable surface of an article of manufacture exposed to water condensation has less of a tendency to drip droplets of water therefrom than a surface which is not water wettable. Instead of dripping in a random fashion from the surface, the water migrates downwardly along the surface in a predictable path and if droplets form, they can be collected at a predetermined desired point. An example of articles of manufacture where water wettability is a necessary property is an aluminum refrigerator evaporator, whose external surfaces conventionally are rendered permanently water wettable by metal anodizing, and the external surfaces of other evaporators and heat exchangers whose efficiency is dependent on the surfaces being wet with water. Other examples of articles of manufacture in which water wettability is a desirable property are those which are maintained below ambient temperature in a humid atmosphere and which are therefore susceptible to condensation and dripping, e.g., plastic, for example, PVC, polyethylene, and metal, for example, aluminum, copper and iron, cold water pipes and sheets forming the interior surfaces of refrigerators.

Another example of articles of manufacture where water wettability is a desirable or necessary property are those formed of or having a coating on the surface thereof of a hydrophobic polymer, which are to be coated with an aqueous coating composition. It is difficult and sometimes impossible to apply a uniform coating of a desired aqueous coating composition to such hydrophobic surfaces. Therefore, the surface of the polymer must be physically or chemically altered to render it receptive to the selected aqueous coating composition.

It is relatively simple to render metal surfaces temporarily water wettable. For example, acidic aqueous colloidal dispersions of $\alpha$-alumina are used commercially to render surfaces temporarily water wettable. See Trade Literature "Dispal ® Alumina", Continental Oil Company, Market Development Dept., Saddle Brook, N.J. Although that literature states that the durability of the alumina film is increased by incorporating a small percentage, e.g., 2%, of acrylic emulsion in the dispersion, the wettability imparted by the alumina film is still relatively impermanent and moreover, is far less effective than anodizing in protecting the aluminum substrate from corrosion and/or staining. Therefore, this method of rendering aluminum articles of manufacture water wettable is unsatisfactory for products which are subjected for long periods of time to conditions which could stain or corrode the surface of the aluminum, as is the case of the interior aluminum surfaces of refrigerator boxes and the exterior surfaces of refrigerator and air conditioner evaporators.

The coating of aluminum with polymeric coatings is, of course, well known in the prior art. U.S. Pat. No. 3,464,854 discloses a coating composition which can be applied to aluminum surfaces, consisting of an eposy resin binder in aqueous dispersion with a major amount of particulate filler, e.g., alumina. Additionally, an amine curing agent is provided in the composition. U.S. Pat. No. 3,468,753 describes a method for applying a layer of co-polymer ethylene and unsaturated carboxylic acids such as acrylic and methacrylic acid, which layer may include a filler material, to a metal sheet, e.g., aluminum.

The electrodeposition of acidic polymers on metal substrates is well known. See, e.g., U.S. Pat. Nos. 3,230,162; 3,463,714; 3,494,847; 3,507,765; 3,532,613; 3,556,972; 3,575,902; 3,741,923; and 3,755,119.

The hydrophilization of hydrophobic polymers is also known in the prior art. U.S. Pat. No. 3,935,342 discloses a process wherein hydrophobic polymers are treated by contacting them with silylated acrylate or methacrylate monomers, polymerizing the monomer and then hydrolyzing the polymer to break the siloxy bonds and produce free hydroxy groups. The product can be used in a large number of coating applications. See, Col. 1, lines 45–53.

It is an object of this invention to provide a process for rendering non-polar or hydrophobic surfaces permanently water wettable. Another object is the provision of novel articles of manufacture having a surface rendered permanently water wettable according to the process of this invention. Other objects will be apparent to those skilled in the art to which this invention pertains.

SUMMARY OF THE INVENTION

In a process aspect, this invention relates to a process for rendering permanently water wettable a surface of an article of manufacture which normally is not permanently water wettable, which comprises the steps of:

(a) coating the surface with a continuous coherent film of the free acid form of a film forming acidic polymer which forms water soluble salts and which is curable to water insolubility, said film containing a curing agent for the polymer;

(b) contacting the thus-coated surface, under acidic aqueous conditions which retain the polymer coating on the surface, with colloidal alumina or a water soluble polyvalent metal salt;

(c) curing the thus-contacted polymer on the surface to water insolubility, and, when required to render the cured polymer water wettable, thereafter hydrolyzing substantially only the surface portion of the cured polymer.

In an article of manufacture aspect, this invention relates to aluminum articles of manufacture formed of aluminum presenting a surface rendered permanently water wettable by a water-insoluble coating thereon of a water-soluble acidic polymer which has been cured to water-insolubility and has been rendered water wettable according to the process of this invention.

DETAILED DISCUSSION

The articles of manufacture whose surface can be rendered permanently water wettable according to the process of this invention are those formed from materials which normally are not water wettable or which lose their water wettability after manufacture, upon exposure to air and/or water and thus include those formed from a metal, e.g., aluminum, copper, brass, bronze, nickel, iron, stainless steel and noble metals, e.g., gold, silver and platinum, and those formed from or coated with a water insoluble hydrophobic polymer, including the thermoplastics, e.g., polystyrene, styrene-acrylonitrile resins, polyvinyl chloride, polyvinyl acetate, polyethylene, polypropylene, polybutenes, acetals, acrylics, thermoplastic polyesters and nylons, and the thermoset polymers, e.g., alkyd, epoxy, phenolic, phenol-aralkyl, urea and melamine resins and thermoset unsaturated polyesters and polyurethanes. If the article of manufacture is formed of or coated with a polymer, necessarily the polymer must be one which can be coated with a water soluble acidic polymer as defined herein and which is stable in the curing step. Preferred substrates are those formed from a base metal, especially those formed from aluminum or an aluminum alloy, e.g., of high Si content, or a composite of aluminum and steel because, inter alia, the aluminum is protected from the staining which occurs on unprotected aluminum, as well as being rendered permanently water wettable.

The article of manufacture can be in any solid shaped form, including rigid and flexible sheets, films, foils and extruded, cast, stamped and machined three-dimensional shaped articles, indcluding water pipes and the heat exchanger surfaces of air conditioners and evaporators and the frames of refrigerator doors, drain troughs, fresh food liner tops and other refrigerated areas which are susceptible to sweating. Preferred are those forming the heat exchanger surface of evaporators, especially aluminum refrigerator evaporators, and other fabricated metal articles of manufacture.

The acidic polymers used to coat the starting substrate are those which:

(a) form water soluble salts;

(b) will form a continuous coherent film on the selected substrate; and (c) are curable to water-insolubility.

These properties, rather than the specific chemical structure of an acidic polymer, determine its suitability for use in this invention. Therefore, a wide variety of structural types of film-forming acidic polyelectrolytes can be employed, including homopolymers of acrylic and methacrylic acid having polymer units of the formula $$\left(\begin{array}{c}COOH\\ |\\ CR-CH_2\end{array}\right)_n$$

wherein R is H or $CH_3$ and n is an integer, e.g., about 900 or higher, and copolymers with other monomers which form soluble amine or ammonium salts, e.g., vinyl alkyl ether-maleic acid copolymers. Acidic polymers in which the acidic group is a sulfonic acid group, e.g., polystyrene sulfonic acids and polyethylene-sulfonic acids, a sulfato group, e.g., partially sulfated polyvinyl alcohol, or a phosphonic acid group, e.g., polyvinyl phosphonic acid, are also operable, as are incompletely hydrolyzed alkyl acrylate and alkyl methacrylate polymers, i.e., polymers having polymer units of the formula $$\left(\begin{array}{c}COOR_1\\ |\\ CR-CH_2\end{array}\right)_n$$

wherein R and n are as defined above and a portion of the $R_1$ groups are alkyl, e.g., methyl or ethyl, and a remainder portion, sufficient to render ammonium and/or amine salts of the polymer water soluble, are H. Preferred are the polymers of acrylic acid. For a discussion of such polymers, see Encyclopedia of Polymer Science and Technology, Vol. 10, pp. 781 et seq. (John Wiley & Sons, Inc. 1969); Kirk-Othmer, Encyclopedia of Chem. Tech., Vol. II, pp. 874 et seq.; Davidson & Sittig, Water Soluble Resins, 2nd Ed., Chapter 8 (Reinhold Pub. 1968); D. H. Solomon, The Chemistry of Organic Film Formers, Chapter 10 (John Wiley & Sons, Inc., 1967).

The polymers are those which form water soluble salts with bases. The term "water soluble" as used herein embraces "colloidally dispersible in water", since many of the high molecular weight polymers which are operable in the process of this invention form colloidal dispersion in water rather than true solutions.

A preferred class of acidic polymers which are soluble or colloidally dispersible in water are those which can be deposited as a film on a metallic substrate by anodic electrodeposition, e.g., a co-polymer of acrylic acid, methacrylic acid, crotonic acid, $\beta$-benzoyl-acrylic acid, fumaric or maleic acid and of an alkyl acrylate, a styrene, an alkyl styrene, a vinyl monomer, e.g., vinyl chloride, vinyl acetate acrylamide, or a vinyl monomer having an alcoholic hydroxy group, e.g., the hydroxyalkyl esters of acrylic acid, alone or in combination with one of the other monomers named above. Preferably, the acidic polymer has an electrical equivalent weight between about 1,000 and 20,000 and an acid number of at least 20, preferably about 30 to 300. Another class is an at least partially neutralized reaction product of a drying oil fatty acid ester with an $\alpha,\beta$-ethylenically unsaturated dicarboxylic acid or an anhydride thereof, e.g., maleic or itaconic anhydride, maelic, itaconic or fumaric acid. Still another class is the polyamide acid reaction product of a dianhydride, e.g., benzophenone dianhydride or pyromelletic dianhydride, and a diamine, e.g., a $C_{2-8}$ alkylenediamine or m-phenylenediamine. Still another class is an at least partially neutralized dicarboxylic acid of a block copolymer of $\alpha$-methylstyrene and an aliphatic conjugated diolefin of 3–6 carbon atoms. A further class is a polycarboxylic acid resin having olefinically unsaturated side chain produced by first reacting a polydioxylated polymer with an olefinically unsaturated acyclic carboxylic acid of about 18 carbon atoms, reacting this product with trimellitic anhydride and reacting this product with a polyolefin glycol of a molecular weight greather than about 200. Another class are the heat curable acrylate resins containing 50–90% by weight of an ester of acrylic and/or methacrylic acid and a monoalcohol of 1–8 carbon atoms, 1–15% by weight of at least one copolymerizable olefinically unsaturated carboxylic acid of 3–5 carbon atoms, e.g., itaconic acid, acrylic or methacrylic acid; and 5–49% by weight of a further copolymerizable olefinically unsaturated compound, e.g., vinyl piralate, styrene acrylonitrile, acrylamide and/or ethers of methylolacrylamide and methacrylamide, e.g., N-butoxymethylmethacrylic acid amide and ethylene glycol esters of acrylic acid. For a further description of such electrodepositable acidic polymers, see U.S. Pat. Nos. 3,230,162; 3,463,714; 3,494,847; 3,507,765; 3,532,613; 3,556,972; 3,575,902; 3,741,923; and 3,755,119, whose disclosures are incorporated herein by reference.

In addition to ammonia, a wide variety of amines can be employed to render the polymer water soluble. Preferred are those conventionally employed to form water soluble amine salts of polymers, viz., low molecular weight aliphatic amines, preferably tertiary alkylamines, alkanolamines and cycloaliphatic amines, e.g., dialkylaminoalkanols. When the acidic polymer is deposited on the substrate as an amine salt, the amine must be sufficiently volatile to be removed when the coated substrate is dried. Examples of such amines are dimethylaminoethanol, ethanolamine and triethylamine.

Necessarily, the selected polymer must be one which is capable of forming a continuous film on the starting substrate. The preferred acrylic acid polymers will form such films on many substrates. However, with some polymers and/or hydrophobic substrates, some adjustment of the vehicle from which the polymer is deposited, e.g., by varying the concentration of the polymer therein or adding a wetting agent and/or an organic solvent thereto, may be required. However, such techniques are standard and will known in the coating art.

The film of the selected acidic polymer deposited on the selected substrate must also be curable to water insolubility both at acid and alkaline pH's. In other words, the cured polymer is neither water soluble nor forms water soluble salts. This is accomplished by including a curing agent in the film deposited on the selected substrate. Such curing agents conventionally are cross-linking agents for the polymers and which effect cross-linking when the film is heated or is exposed to another form of energy required to initiate the cross-linking reaction, e.g., actinic or ultraviolet light or gamma ray irradiation. In addition to the activating energy, a reaction catalyst is sometimes also required. To the extent one is required, e.g., hydrochloric or p-toluenesulfonic acid, it is included in the term "curing agent" as used herein.

An example of a class of curing agents for acidic polymers are water soluble aminoplasts and their precursors which cross-link the acidic polymers. Aminoplasts are a conventional component in coating compositions. Many of these have the formula —NH—$CH_2$—OR wherein R is hydrogen or alkyl of one to four carbon atoms and the unsatisfied valence is an organic moiety. Examples are the condensation products of aldehydes, particularly formaldehyde, with several amino- or amido-group-carrying substances, such as, for example, with melamine, urea, N,N'-ethyleneurea, dicyanodiamide, and benzoguanamine. There can also be used water soluble polymers having the structure of copolymerizates into which is polymerized an amide of an $\alpha$-ethylenically unsaturated carboxylic acid having N-methylol- and/or N-methylol-ether groups.

Aminoplasts which are modified with alcohols, preferably alkanols of one to four carbon atoms, can also be used. In place of these resinous products, it is preferable to employ precursors of aminoplasts, e.g., dimethylol urea, tetramethylol benzoguanamine, trimethylol melamine or hexamethylol melamine, which can also be employed in a partially or completely etherified form, for example, as dimethoxymethyl urea, tetrakis(methoxymethyl)benzoquanamine, tetrakis(ethoxymethyl)benzoguanamine, or polyethers of hexamethylol melamine, such as hexakis(methoxymethyl)melamine or hexakis(-butoxymethyl)melamine. It is also possible to use mixtures of all the above N-methylol products.

Thus, a wide variety of commercially available aminoplasts can be used for combining with the special polyesters of the present invention. For more details regarding the aminoplasts which can be used, see "Organic Protective Coatings," Von Fischer and Bobaleck, 1953, Reinhold, pages 210–255.

In step (b) of the process of this invention, the free acid form of the acidic polymer forming the coating on the substrate is contacted under aqueous conditions with colloidal alumina or a water soluble salt of a polyvalent metal, i.e., a metal having a valence greater than one.

Of the salts of polyvalent metals, preferred are salts of metals of the Group IB, IIA, IIB, IIIA, VIIB or VIII series, more preferably of Mg, Al, Ca, Mn, Fe, Co, Ni, or Zn. Of these, the aluminum and divalent metal salts, e.g., magnesium, calcium and manganous salts are especially preferred. The cation can be that of any organic or inorganic acid or acidic compound which forms a soluble salt with the selected metal, including organic carboxylic acids, e.g., acetic; organic sulfonic acids, e.g., benzenesulfonic and p-toluenesulfonic; and inorganic hydrohalic acids and acids of sulfur and phosphorous, e.g., hydrochloric, sulfuric and phosphoric acids.

In carrying out Step (a) of the process of this invention, a surface of the selected starting substrate is coated with a continuous film of the free acid form of the selected acidic polymer containing a curing agent for the polymer. This can be accomplished in one embodiment by dipping the surface of the substrate in or spraying the surface of the substrate with an aqueous solution of a mixture of the ammonium salt or a volatile amine salt of the acidic polymer and curing agent and then drying the film below curing temperature to drive off free ammonia or amine from the film. The drying step is ordinarily required to render the surface portion of the polymer film receptive to the colloidal alumina or polyvalent metal salt employed to render the polymer coating water wettable. presumably, this enhanced receptiveness of the polymer is due to partial conversion of the polymer to the free acid form by the liberation of part of the amine or ammonia thereof during the drying step, since a drying step is not required when the polymer coating is applied electrolytically, as described hereinafter. Apparently, a drying step is not required because the polymer is deposited electrolytically on the substrate substantially in its free acid form, rather than as an amine or ammonium salt thereof when the polymer is applied by immersing the substrate in or spraying it with a solution of the ammonium or amine salt of the acidic polymer.

The film of the acidic polymer is applied electrolytically to the substrate by employing the substrate as an anode and the aqueous solution of the ammonium or amine salt of the acidic polymer as the electrolyte in an electrolysis system. For a description of techniques for doing so on a commercial scale, see "William Brushwell Reports: Coatings, Update," American Paint & Coatings Journal, pp. 65–70, Oct. 3, 1977; Loyd R. Brower, Jr. Standard T Chemical Co., Inc., Technical Bulletin, "Electro-Painting Principles and Process Variables." For a comparison of anodic and cathodic electrodeposition processes, see Wismar and Busso, "Make the Part the Cathode: Key to Resistant Coatings," Chem. Eng. pp. 115–118, June 14, 1971, and references cited therein.

To deposit the polymer electrolytically, necessarily the substrate must be electroconducting. Therefore, for all practical purposes, this technique is limited to metal substrates. Of these, aluminum is preferred. Typically, the substrate to be coated is electrically connected to the positive terminal of a source of direct current and the portion of the substrate to be coated with the polymer is immersed in an aqueous solution of a salt of the polymer, along with a cathode connected to the negative terminal source of direct current. A voltage is then imposed on the solution which produces the amperage required to deposit the polymer. As is well known in this art, this coating is self-limiting because of the reduction in electroconductivity of the substrate resulting from the polymer film deposited thereon.

The acidic polymer is preferably dissolved in the form of an ammonium or amine salt thereof. Although metal, e.g., Na or K, salts are also operable, they are not preferred because a portion of the solubilizing cation is occluded in the deposited film and an acid washing step way be required to remove enough metal ion to render the polymer receptive to the colloidal alumina or polyvalent metal salt, whereas such a step ordinarily is not required when the ammonium or an amine salt is employed.

A film of the free acid form of the polymer can also be applied to the substrate by coating the substrate with a solution of the free acid form of the polymer in an organic solvent and then volatilizing the organic solvent, or by electrostatic spraying or hot melt techniques, employing conditions which leave a continuous film of the free acid form of the polymer on the substrate. Such conditions are well known in the coating art.

Preferably, the polymer coating applied to the substrate has a thickness of about $3\times10^{-3}$ to about $40\times10^{-3}$ mm., more preferably about $9\times10^{-3}$ mm. The thickness of the coating can be regulated by the concentration of the polymer in the solution, the viscosity of the solution, the number of immersions, the spraying time and/or the final voltage when the coating is applied electrolytically.

After the coating has been applied, it is sometimes desirable to wash the coating with water or acid to remove extraneous anions therefrom or to convert the polymer more completely to its free acid form. As stated above, a heating step is required, if the polymer is deposited as its ammonium or amine salt, to volatilize the ammonia or amine, thereby converting the polymer to its free acid form.

In step (b) of the process of this invention, the free acid form of the acidic polymer forming the film coating on the substrate is contacted with colloidal alumina or with a water soluble salt of a polyvalent metal under aqueous conditions, preferably at a pH of less than 7, e.g., about 3 to 5.

The acidic polymer forming the coating on the substrate can be hydrated or dry when contacted with the colloidal alumina or the divalent metal salt under aqueous conditions. If the polymer is moist, the colloidal alumina or polyvalent metal salt can be applied as a dry solid, preferably a micronized powder, with the moisture of the coating providing the requisite aqueous vehical for the interaction of the alumina or metal salt with the acidic polymer. However, it is ordinarily more convenient and preferred to employ an aqueous suspension of the alumina or aqueous solution of the metal salt.

Since the interaction thereof with the acidic polymer occurs predominantly only on the surface of the polymer coating, the theoretical minimum amount of alumina or metal salt required to effect the requisite interaction with the acidic polymer is miniscule. This theoretical minimum can be calculated from the surface area of the polymer coating and the number of acid groups thereon. However, it is not necessary to do so because the most convenient method of contacting the acidic polymer with the alumina or metal salt is by immersing the coated substrate in an aqueous colloidal suspension of the alumina or aqueous solution of the metal salt, thereby contacting the acidic polymer with an amount of alumina or metal salt far in excess of the theoretical minimum.

The aqueous colloidal suspension of the alumina and the aqueous solution of the selected polyvalent metal salt are ordinarily acidic. However, to the extent a neutral colloidal suspension of the alumina or solution of the metal salt can be formed, they also can be employed, so long as the polymer is in its free acid form when contacted therewith.

In step (c) of the process of this invention, the polymer coating on the substrate is rendered permanent by curing the polymer to water insolubility, i.e., both the free acid form of the polymer and salts thereof are insoluble in water. The conditions employed in the curing step are determined by the selected polymer and curing agent therefor. Although curing of the acidic polymer can be achieved with some curing agents and acidic polymers by irridiation with actinic, or ultraviolet light or gamma rays, it is ordinarily preferred to cure by heating the coated substrate, e.g., at about 135° to 250° C., preferably about 150°–200° C., until the acidic polymer is insolubilized, usually for a few minutes, e.g., from about 30 seconds to one or more hours, preferably about 5 to 30 minutes. Methods for determining the optimum conditions of time and temperature are well known in the coating art.

The cured polymer ordinarily is not water wettable and therefore hydrolysis of the surface portion thereof is required to impart water wettability thereto. Only when the acidic polymer is contacted with the colloidal alumina or the polyvalent metal salt under conditions of cathodic electrodeposition is the polymer coating water wettable after curing without the necessity of a subsequent hydrolysis step. However, only a mild hydrolysis at any pH is required, e.g., water at 70° to 100° C. for about 30 to 5 minutes; dilute aqueous $NH_4OH$ or NaOH, e.g., 0.25–0.05 M, at 20° to 70° C. for about 10 minutes to 10 seconds; or dilute acetic or sulfuric acid, e.g., 0.01 to 0.1 M, at 20° to 70° C. for about 10 to 1 minutes.

The cured and, when required, also surface hydrolyzed, polymer coating on the substrate is permanent as evidenced by its resistance to abrasion, i.e., 10 finger strokes with a wet paper towel, and resistance to water, i.e., 10 days immersion at 49° C. It is water wettable, as evidenced by the retention of a substantially continuous film of water thereon while in a vertical position for at least 10 seconds after immersion in or flooding with water. It is permanently water wettable, as evidenced by its ability to retain its water wettability after being immersed for 240 hours in water at 49° C.

Without further elaboration, it is believed that one skilled in the art can, using the preceding description, utilize the present invention to its fullest extent. The following preferred specific embodiments are, therefore, to be construed as merely illustrative and not limitative of the remainder of the disclosure in any way whatsoever.

EXAMPLE 1

50.9 grams of hexamethoxymethylmelamine (American Cyanamide, Cymel® 303) was added to 204.6 grams of Celanese ED 25166 acrylic acid resin (acid value 80±3). The mixture was blended thoroughly with a spatula. To this mixture was added 17.0 grams of 2-dimethylethanolamine. The mixture was blended with a spatula and while stirring, 527.5 grams of deionized water was added very slowly, until a uniform solution was obtained. This solution was diluted by adding an additional 800 milliliters of deionized water.

A clean aluminum and a clean stainless steel panel were partially immersed in the above solution. The exposed portions of the aluminum and stainless steel panels were electrically wired to the positive and negative output terminals respectively of a direct current rectifier, such that when energized, the aluminum panel would have a positive potential with respect to the stainless steel panel. The voltage was increased from zero to 25 volts while maintaining current flow at about one ampere. When the applied voltage reached 25 volts, the voltage was held constant for 10 minutes. The aluminum panel was separated from the rectifier and the coating deposited on the aluminum panel was rinsed with deionized water.

The rinsed panel was then dipped for three seconds in a colloidal dispersion of hydrated aluminum oxide prepared by adding 19 grams of glacial acetic acid to 877 grams of deionized water in a General Electric Model BL3 blender; with the blender on stir, slowly adding 104 grams of Conoco "Catapal"® SB Alumina to the dilute acid; stirring the mixture for one hour; and then diluting the mixture with an equal volume of deionized water.

The coated panel was then heated in a forced air oven for 20 minutes at 182° C. The panel was allowed to cool to approximately 65° C. and the coated portion of the panel was immersed in tap water for 15 minutes at 93° C.

The coated panel was wetted under running tap water and upon removal from the running stream, the water sheeted or spread only on the portion of the panel which had received the 93° C. water treatment. The sheet was retained for more than 10 seconds with the panel in a vertical position. The contact angle of deionized water on the wettable portion of the panel was 53°-56°. The coating was abrasion resistant requiring 51 cycles with an RCA tape abrader (273 gram load) before wearing through the approximately $5\text{-}7.5\times10^{-3}$ mm. coating. The panel was immersed in 49° C. water for 4 days. The uncoated portion of the panel turned very dark as a result of this exposure but the coated portion of the aluminum appeared to be in as-produced condition.

EXAMPLE 2

An aqueous coating solution of acrylic acid polymer and curing agent was prepared by blending with a spatula 23.8 grams of hexamethoxymethylmelamine (American Cyanamide Cymel® 303) and 8.2 grams of 2-dimethylethanolamine with 99.0 grams of Celanese ED25166 acrylic acid resin. Next, a mixture of 4.7 grams of Cellosolve, 0.8 grams of Cymel 303 and 0.5 grams of American Cyanamide 4040 Acid Catalyst were spatula blended and then added to the above mixture and 250 grams of deionized water was added very slowly with stirring until a uniform solution was obtained. This solution was then diluted by adding thereto an equal volume of deionized water.

A clean aluminum panel was dipped in the resulting solution for approximately 3 seconds and after withdrawal was heated for 5 minutes at 121° C. The panel was cooled with deionized water and then immersed for approximately 3 seconds in a colloidal dispersion of alumina prepared as described in Example 1, to which was then added to 200 ml. thereof, 1.0 grams of Rohm and Haas Triton CF 54 and 0.5 grams of Wyandotte Chemical Corporation Pluronic L61 wetting agents. The coated panel was then heated in a forced air oven for 20 minutes at 178° C. The panel was then wetted under running tap water. Upon removal, the water formed a continuous sheet on the coated panel which persisted with the panel positioned vertically for about 10 sec. The coating is permanent, as evidenced by inertness to water immersion (for 11 days at 49° C.) and resistance to abrasion with a wet paper towel—10 finger strokes.

EXAMPLE 3

Electrolytically coat a clean surface of an aluminum substrate with an about 9 mm. coating of polyacrylic acid according to the procedure of Example 1. After rinsing with deionized water, dip the coated substrate in a 0.06 M (pH about 4) solution of magnesium sulfate in deionized water. Without rinsing, cure the coating on the substrate to water insolubility by heating in a forced air oven at 182° C. for 20 minutes and then hydrolyze the surface portion only of the cured polymer by immersing the coated substrate in hot (93° C.) water for about 15 minutes, thereby rendering the coated substrate water wettable.

Comparable results are obtained by substituting a like solution of manganous sulfate or calcium acetate for the magnesium sulfate. Other acidic solutions of soluble salts of polyvalent metals, e.g., aluminum acetate, zinc sulfate, cuprous sulfate, cobalt sulfate and nickel sulfate, can also be substituted for the magnesium sulfate.

EXAMPLE 4

Follow the procedure of Example 1, but hydrolyze the coated substrate with 0.25 M NaOH at 60° C. for 15 sec. or at room temperature for 1-2 min., 0.05 M $H_2SO_4$ at 38° C. for 5 min., 0.05 M acetic acid at 60° C. for 5 min., or 0.05 M $NH_4OH$ at room temperature for 2 min.

EXAMPLE 5

Follow the procedure of Example 1 except use 100 volts applied for 1 minute. Then immerse the acrylic acid polymer coated panel, after rinsing with deionized water, and the stainless steel panel in the colloidal alumina dispersion, connect them as negative and positive output terminals, respectively, to a direct current rectifier and apply a 75 volt potential for 1 minute. A second coating of alumina is deposited on the coated panel. Without rinsing, heat the coated aluminum panel in a forced air oven for 20 minutes at 178° C. The resulting coated aluminum panel is water wettable, having a water contact angle of 51°-61° and is permanent as evidenced by inertness to water immersion for 10 days at 49° C.

EXAMPLE 6

A preferred method of performing the process of this invention on a commercial scale is shown schematically in the drawing.

A fresh food evaporator for a Model TB14 General Electric home refrigerator from the fabricating plant is immersed in a cleaner (Chemetron Alkalume® Ac 8) for one min. at 77° C., then sprayed with a water rinse for 30 sec. at 60° C., then sprayed with recirculating deionized water for 30 sec. at room temperature and then for 5 seconds with fresh deionized water at room temperature.

The washed evaporator is then connected to the positive terminal of a direct current rectifier, the negative terminal of which is connected to a stainless steel cathode immersed in a 120 gal. recirculating bath of deionized water containing (by weight) 12.8% Celanese ED 25166 brand polyacrylic acid resin (75% solids by weight) with an acid value of 80±3, 3.2% Cymel 303 (American Cyanamid) brand of hexamethoxymelamine and 1.1% of dimethylethanolamine. The evaporator is immersed in the bath for one minute while passing a direct current (100 volts, average draw 1 amp/ft$^2$) through the bath, thereby depositing a uniform continuous coherent film (about $9\times10^{-3}$ mm. thick) of the polymer containing the methoxymelamine and dimethylethanolamine on the exposed surfaces of the evaporator.

The coated evaporator is removed from the bath and rectifier and washed for 30 seconds with deionized water. The washed evaporator is then immersed at room temperature for 30 seconds either in (a) 130 gallons of the acetic acid acidified, stirred aqueous suspension of colloidal alumina described in Example 1, or (b) 130 gallons of a 0.06 molar solution of magnesium sulfate in deionized water.

Without rinsing, the coated evaporator is then transferred to a circulating hot air (177° C.) for 20 minutes. The evaporator is then dipped for 15 seconds in 0.25 M NaOH at 60° C. and then spray rinsed with water at room temperature for one minute. The thus-treated evaporator when wet with water forms a substantially continuous film of water on its surface which persists for at least 10 sec.

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A process for rendering permanently water wettable a surface of an article of manufacture which normally is not water wettable or which loses its water wettability upon exposure to air or water, which comprises the steps of:

(a) coating the surface with a continuous film of the free acid form of a film forming acidic polymer which forms water soluble salts and which is curable to water insolubility, said film containing a curing agent for the polymer;

(b) contacting the thus-coated surface, under aqueous conditions which retain the polymer coating on the surface, with colloidal alumina or a water soluble salt of a polyvalent metal;

(c) curing the thus-contacted polymer on the substrate surface to water insolubility; and, if required to render the cured polymer coating water wettable, thereafter hydrolyzing substantially only the surface portion of the cured polymer.

2. The process of claim 1 wherein the surface is metal.

3. A metal article of manufacture presenting a surface rendered permanently water wettable by a water-insoluble coating thereon of a water-soluble acidic polymer which has been cured to water-insolubility and rendered water wettable according to the process of claim 2.

4. The process of claim 2 wherein the metal is aluminum.

5. The process of claim 4 wherein the article of manufacture is a refrigerator evaporator.

6. An article of manufacture formed of aluminum presenting a surface rendered permanently water wettable by a water-insoluble coating thereon of a water-soluble acidic polymer which has been cured to water-insolubility and rendered water wettable according to the process of claim 4.

7. An aluminum article of manufacture according to claim 6 wherein the polymer is a polyacrylic acid.

8. An aluminum refrigerator evaporator according to claim 7.

9. A process of claim 1 wherein the polymer and the curing agent are applied to the surface from an aqueous solution of a mixture of the curing agent and an ammonium or amine salt of the polymer.

10. A process of claim 9 wherein the surface is a metal and the surface is coated with the polymer in free acid form by anodic electrodeposition.

11. The process of claim 9 wherein the surface is coated with the ammonium or amine salt of the polymer and the polymer in the coating is then converted to its free acid form prior to step (b) by heating the coating below the curing temperature of the polymer.

12. The process of claim 1 wherein the curing agent for the polymer is a cross-linking agent for the polymer under the influence of heat and the polymer is cured by heating.

13. The process of claim 12 wherein the cross-linking agent is a melamine-formaldehyde condensate.

14. The process of claim 1 wherein the polymer is a polyacrylic acid.

15. The process of claim 1 wherein in step (b) the coated surface is contacted with an acidic aqueous colloidal dispersion of alumina.

16. The process of claim 1 wherein in step (b) the coated surface is contacted with an acidic aqueous solution of salt of magnesium, aluminum, calcium, manganese, iron, cobalt, nickel, copper or zinc.

17. The process of claim 16 wherein the salt is a manganous salt.

18. The process of claim 16 wherein the salt is a magnesium salt.

19. The process of claim 16 wherein the salt is a calcium salt.

20. The process of claim 16 wherein the salt is an aluminum salt.

21. The process of claim 1 wherein in step (c) the polymer is hydrolyzed with water at a pH of 7 or higher.

22. The process of claim 1 wherein the polymer coating has a thickness of about $3\times10^{-3}$ to about $40\times10^{-3}$ mm.

23. The process of claim 1 wherein in step (b) the coated surface is immersed briefly in the aqueous dispersion or solution.

24. The process of claim 1 wherein the surface is aluminum, wherein the curing agent is a cross-linking agent for the polymer under the influence of heat, wherein the acidic polymer is a polyacrylic acid which is coated on the surface in step (a) from an aqueous solution of an ammonium or amine salt thereof, and wherein in step (c) the polymer is cured by heating.

25. The process of claim 24 wherein in step (a) the surface is coated with the polymer in free acid form by anodic electrodeposition.

26. The process of claim 25 wherein in step (b) the coated substrate is immersed in an acidic aqueous colloidal dispersion of alumina or with an acidic aqueous solution of the polyvalent metal salt while the substrate is a cathode in a field of direct electrical current passed through the suspension or solution, thereby forming a coating on the substrate which is permanently water wettable upon curing.

27. The process according to claim 26 wherein in step (b) the coated substrate is connected to the negative terminal of a source of direct current and is immersed into an acidic aqueous colloidal dispersion of alumina, through which the direct current is passed.

28. The process of claim 24 wherein the polymer coating has a thickness of about $3\times10^{-3}$ to about $40\times10^{-3}$ mm.

29. The process of claim 28 wherein the article of manufacture is a refrigerator evaporator, wherein in step (a) the surface is coated with the polymer in free acid form by anodic electrodeposition, and wherein in step (b) the coated surface is immersed briefly in an acidic aqueous colloidal dispersion of alumina.

30. The process of claim 28 wherein the article of manufacture is a refrigerator evaporator, wherein in step (a) the surface is coated with the polymer in free acid form by anodic electrodeposition, and wherein in step (b) the coated surface thereof is immersed briefly in an acidic aqueous solution of a magnesium, aluminum, calcium or manganous salt.

31. The process of claim 24 wherein in step (b) the coated surface is immersed briefly in an acidic aqueous solution of a salt of Mg, Al, Ca, Mn, Fe, Co, Ni, Cu or Zn.

32. The process of claim 31 wherein the metal salt is a magnesium aluminum, calcium or manganous salt.

33. The process of claim 24 wherein the curing agent for the polymer is a melamine formaldehyde condensate.

34. The process of claim 24 wherein in step (b) the coated surface is immersed briefly in an acidic aqueous colloidal dispersion of alumina.

35. The process of claim 24 wherein the article of manufacture is a refrigerator evaporator.

36. A process according to claim 1 wherein in Step (c) the coated surface is rendered water wettable by hydrolyzing substantially only the surface portion of the cured polymer.

* * * * *